US010646988B2

(12) United States Patent
Liao

(10) Patent No.: US 10,646,988 B2
(45) Date of Patent: May 12, 2020

(54) FLUID PUMPING DEVICE HAVING A STORAGE STRUCTURE

(71) Applicant: LIH YANN INDUSTRIAL CO., LTD., Taichung (TW)

(72) Inventor: Po-Lin Liao, Taichung (TW)

(73) Assignee: LIH YANN INDUSTRIAL CO. LTD., Taichung (TW)

( * ) Notice: Subject to any disclaimer, the term of this patent is extended or adjusted under 35 U.S.C. 154(b) by 0 days.

(21) Appl. No.: 16/128,810

(22) Filed: Sep. 12, 2018

(65) Prior Publication Data

US 2019/0283232 A1 Sep. 19, 2019

(30) Foreign Application Priority Data

Mar. 19, 2018 (TW) ..... 107109274 A

(51) Int. Cl.
*B25F 5/02* (2006.01)
*F01M 11/04* (2006.01)

(52) U.S. Cl.
CPC ..... *B25F 5/029* (2013.01); *F01M 11/045* (2013.01); *F01M 11/0458* (2013.01)

(58) Field of Classification Search
CPC ..... B25F 5/092; B25F 5/029; F01M 11/0458; F01M 11/045; A47F 7/0028; A47F 7/0021; B25H 3/04; B25H 3/06; B25H 3/00; B25H 3/003; B25H 1/12; F04B 23/02; F04B 23/025
USPC ..... 211/70.6, 85.18, 85.22, 69; 206/373; 417/572; 15/323, 246.2
See application file for complete search history.

(56) References Cited

U.S. PATENT DOCUMENTS 2,952,498 A * 9/1960 Powers ..... B25H 3/003 312/234.1
3,751,845 A * 8/1973 van Leeuwen ..... A01K 97/05 43/56
4,765,472 A * 8/1988 Dent ..... A47J 47/18 206/373
D304,512 S * 11/1989 Byers ..... D32/35
4,993,551 A * 2/1991 Lindsay ..... B25H 3/00 150/161
5,154,303 A * 10/1992 Jordan ..... B25H 3/06 206/506
5,379,885 A * 1/1995 Chen ..... B25H 3/04 206/216
5,441,163 A * 8/1995 Carrasco ..... B25H 3/00 206/373
5,528,794 A * 6/1996 Tomasiak ..... A47L 9/0009 15/323
5,672,145 A * 9/1997 Pollington ..... B23Q 3/15526 211/1.52
5,833,095 A * 11/1998 Russell ..... A45F 5/02 224/576
5,881,891 A * 3/1999 Murphy, Jr. ..... A47L 13/51 211/65

(Continued)

*Primary Examiner* — Jennifer E. Novosad
(74) *Attorney, Agent, or Firm* — Muncy, Geissler, Olds & Lowe, PC

(57) ABSTRACT

A storage structure for fluid pumping device adapted for disposing on a fluid pumping device comprises: a ring body, sleeved onto the fluid pumping device; a plurality of storage portions, arranged around the ring body, each of the storage portions being adapted for a workpiece to removably connected.

7 Claims, 7 Drawing Sheets

(56) References Cited

U.S. PATENT DOCUMENTS 6,105,768 A * 8/2000 Brown ..... B25H 3/04 206/373
6,237,187 B1 * 5/2001 Hult ..... A47L 5/365 15/323
6,237,451 B1 * 5/2001 Wei ..... B25G 1/085 81/177.4
6,261,276 B1 * 7/2001 Reitsma ..... A61M 1/0023 604/319
6,315,310 B1 * 11/2001 Hurt ..... B62B 1/264 206/373
6,360,891 B1 * 3/2002 Rideout ..... B25H 3/00 206/372
6,729,066 B1 * 5/2004 Howley ..... A01K 97/05 43/54.1
6,832,744 B1 * 12/2004 Pitt ..... A47G 23/02 248/146
D508,596 S * 8/2005 Chochinov ..... D34/10
6,938,299 B2 * 9/2005 Martinez ..... A47L 5/365 15/323
7,040,681 B1 * 5/2006 Broberg ..... B25H 3/04 206/579
7,179,062 B1 * 2/2007 Drevitson ..... A47L 7/0085 15/345
7,431,313 B1 * 10/2008 Torres ..... B25H 3/00 280/124.12
7,845,656 B2 * 12/2010 Thompson ..... B25H 3/00 280/47.35
7,954,649 B1 * 6/2011 Froehlich ..... B25H 3/003 211/163
8,127,965 B1 * 3/2012 Miller ..... B25H 3/04 206/373
8,636,259 B2 * 1/2014 Manke ..... G01N 30/6047 211/78
8,720,703 B1 * 5/2014 Pressler ..... A46B 17/02 211/1.3
8,727,118 B1 * 5/2014 Chen ..... B25H 3/003 206/372
RE46,086 E * 8/2016 Benfield ..... A61G 15/16
9,585,476 B2 * 3/2017 Swisher ..... B25H 1/00
9,717,360 B2 * 8/2017 Krull ..... A47J 47/16
9,956,684 B2 * 5/2018 Welfel ..... B25H 3/06
9,974,392 B1 * 5/2018 Bruning ..... A47C 7/748
2002/0185459 A1 * 12/2002 Dietrich ..... B25H 3/025 211/70.6
2002/0190015 A1 * 12/2002 Dietrich ..... B25H 3/04 211/70.6
2003/0130101 A1 * 7/2003 Hwang ..... B23Q 3/15553 483/59
2004/0003480 A1 * 1/2004 Kovacs ..... A47L 9/00 15/246.2
2004/0060838 A1 * 4/2004 Yu ..... B25G 1/085 206/370
2005/0189250 A1 * 9/2005 Hsu ..... B25H 3/003 206/373
2006/0101955 A1 * 5/2006 Chang ..... B25B 15/008 81/490
2006/0144732 A1 * 7/2006 Kaplan ..... B25H 3/00 206/349
2006/0157946 A1 * 7/2006 Stuemke ..... B62B 5/06 280/79.5
2006/0180559 A1 * 8/2006 Roberti ..... B44D 3/12 211/65
2006/0214384 A1 * 9/2006 Gwin ..... A47L 13/51 280/79.5
2006/0283739 A1 * 12/2006 Wang ..... B25H 3/003 206/379
2007/0023307 A1 * 2/2007 Liu ..... B25H 3/003 206/373
2008/0296187 A1 * 12/2008 Butzen ..... B25H 3/003 206/379
2009/0236250 A1 * 9/2009 Wang ..... B25H 3/003 206/372
2009/0242443 A1 * 10/2009 Chen ..... B25H 3/003 206/375
2009/0255883 A1 * 10/2009 Boyd ..... A47F 5/02 211/70
2011/0226648 A1 * 9/2011 Zhang ..... B25B 15/02 206/374
2013/0244845 A1 * 9/2013 Nagy ..... B25F 5/029 483/12
2014/0366308 A1 * 12/2014 Bullock, Jr. ..... A47L 9/0027 15/323
2015/0158154 A1 * 6/2015 Chen ..... B25B 13/56 206/377
2019/0283232 A1 * 9/2019 Liao ..... B25F 5/029

* cited by examiner

FLUID PUMPING DEVICE HAVING A STORAGE STRUCTURE

BACKGROUND OF THE INVENTION

Field of the Invention

The present invention relates to a storage structure for fluid pumping device.

Description of the Prior Art

Generally, when changing oil such as transmission fluid, the oil in the transmission box has to be drained, and new oil is injected into the transmission box by injector. The injector usually has a pumping mechanism to drain the oil in the transmission box and to inject the new oil into the transmission box.

Transmission boxes are various in types. Different types of transmission box need different connector to be connected to the injector. In a general motor repair shop, different kinds of connector are prepared, and different tools for detaching the connectors are also prepared. It is inconvenient that the user usually hangs the connectors and the tools on the waist or leaves them on the floor. Therefore, the efficiency of changing oil is low.

SUMMARY OF THE INVENTION

The main object of the present invention is to provide a fluid pumping device which is capable of workpiece storage.

To achieve the above and other objects, a fluid pumping device having a storage structure of the present invention comprises: a fluid pumping device, including a barrel and a pumping mechanism, the barrel having an opening, the pumping mechanism being adapted for communicating an interior of the barrel and exterior for pumping fluid; a ring body, sleeved onto the fluid pumping device to surround the opening; a plurality of storage portions, arranged around the ring body, each of the storage portions being adapted for a workpiece to be removably connected.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Please refer to FIG. 1 to FIG. 5 for the first embodiment of the present invention. The storage structure for fluid pumping device is adapted for being disposed on a fluid pumping device 1. The storage structure for fluid pumping device comprises a ring body 10 and a plurality of 20.

Figure 1:
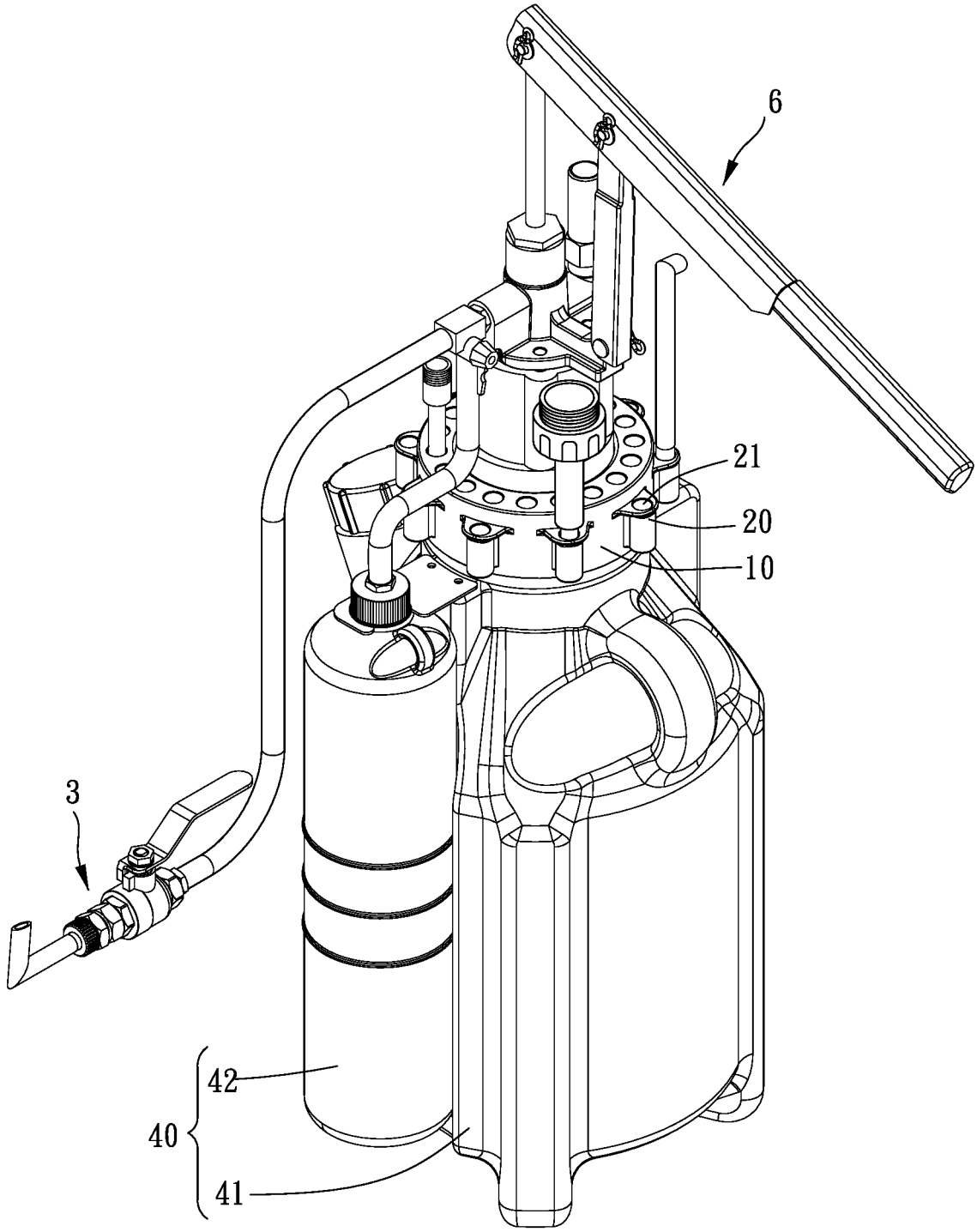
FIG. 1 is a stereogram showing a first embodiment of the present invention.
Figure 2:
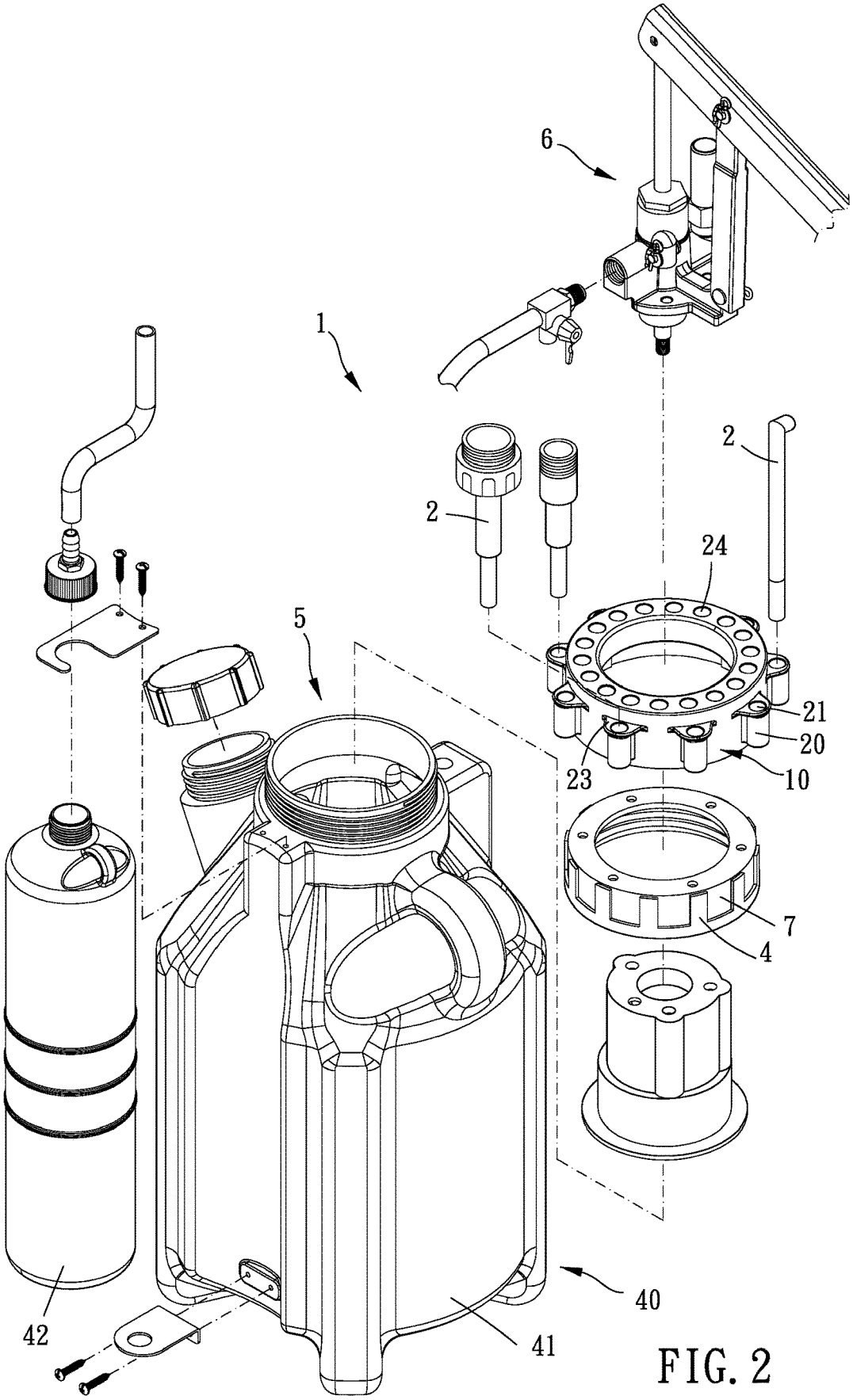
FIG. 2 is a breakdown drawing showing a first embodiment of the present invention.
Figure 3:
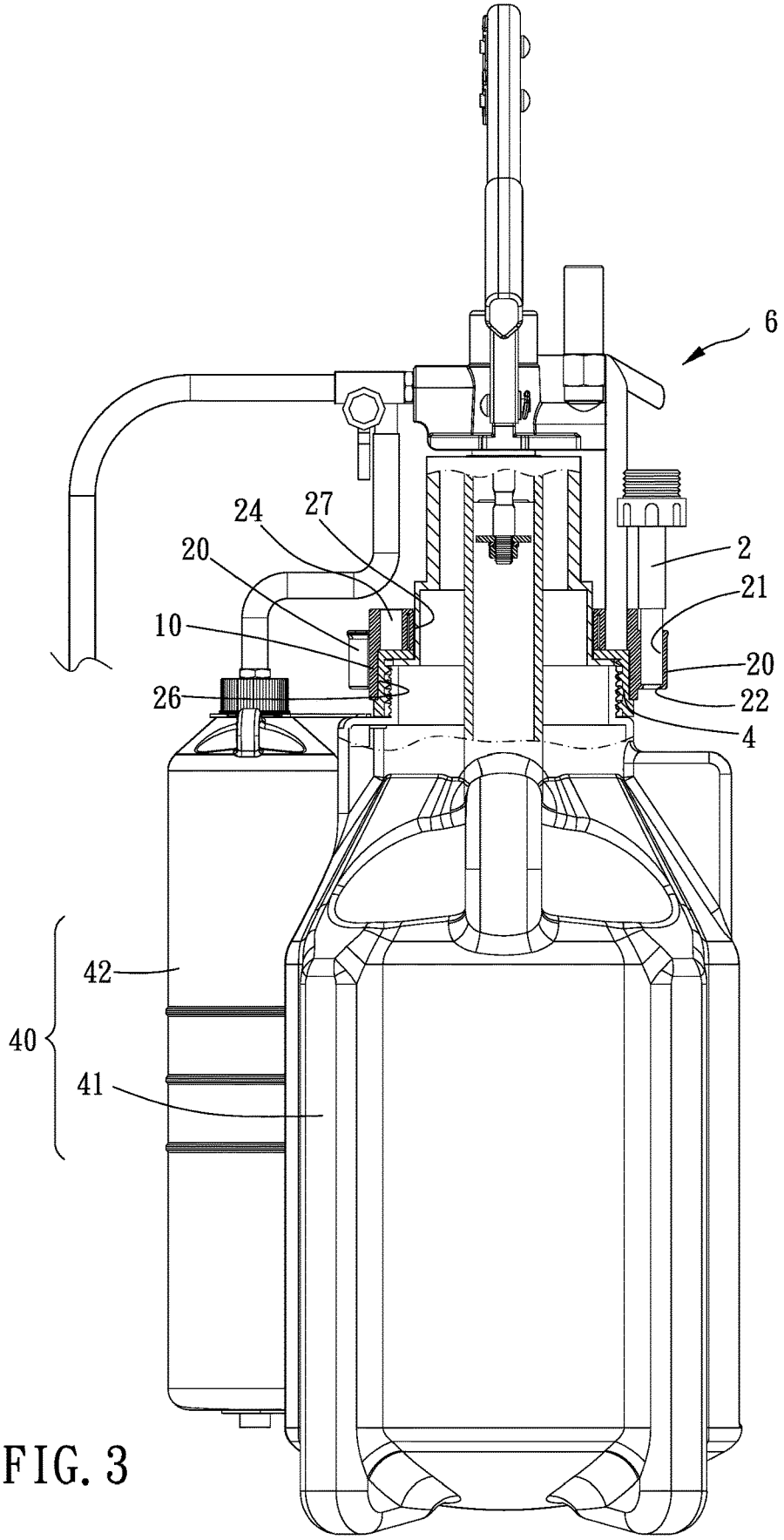
FIG. 3 is a partial profile showing a first embodiment of the present invention.
Figure 4:
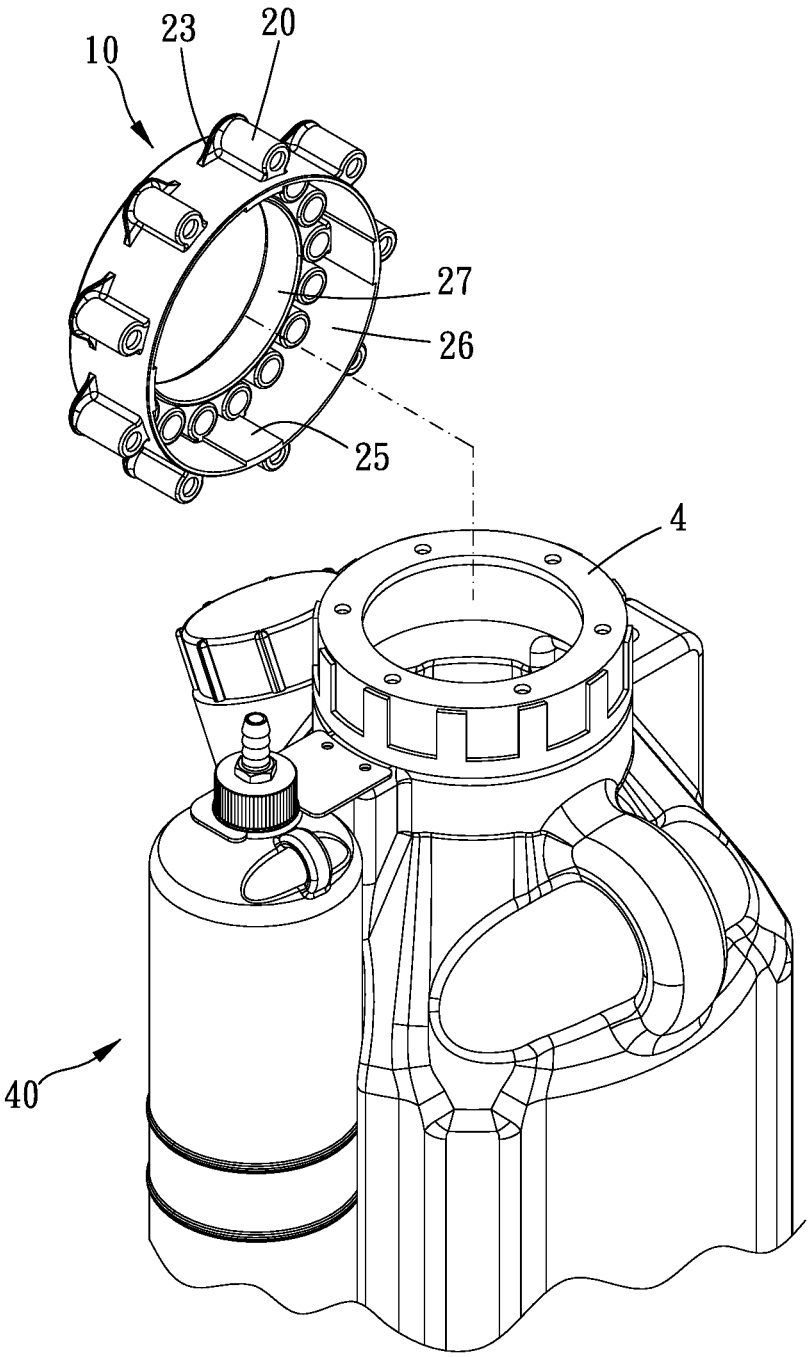
FIG. 4 is a partial breakdown drawing showing a first embodiment of the present invention.
Figure 5:
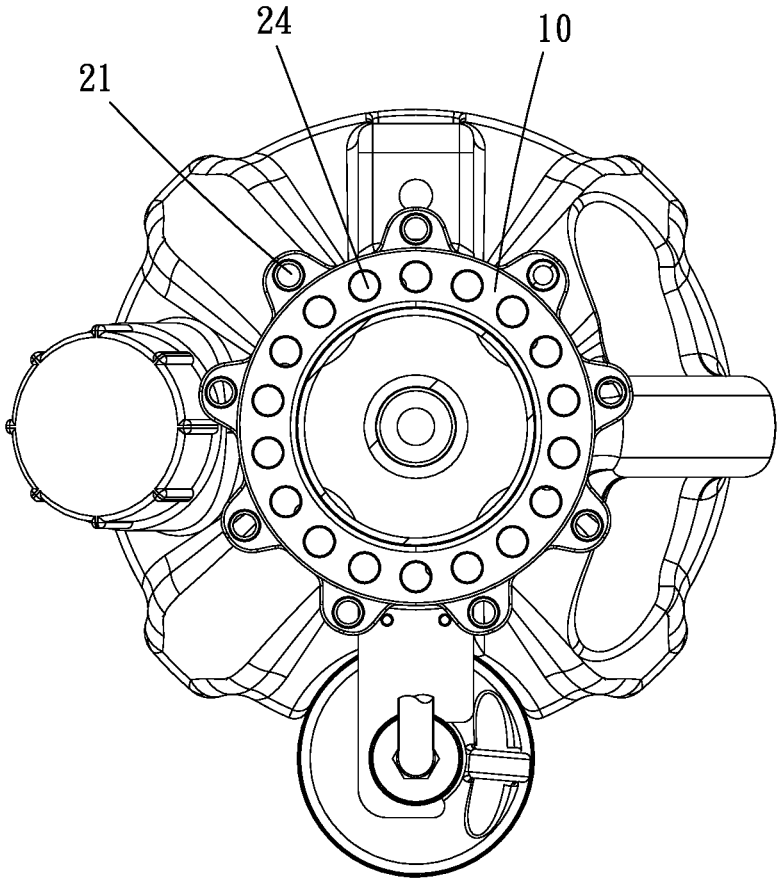
FIG. 5 is a top view showing a first embodiment of the present invention.
Figure 6:
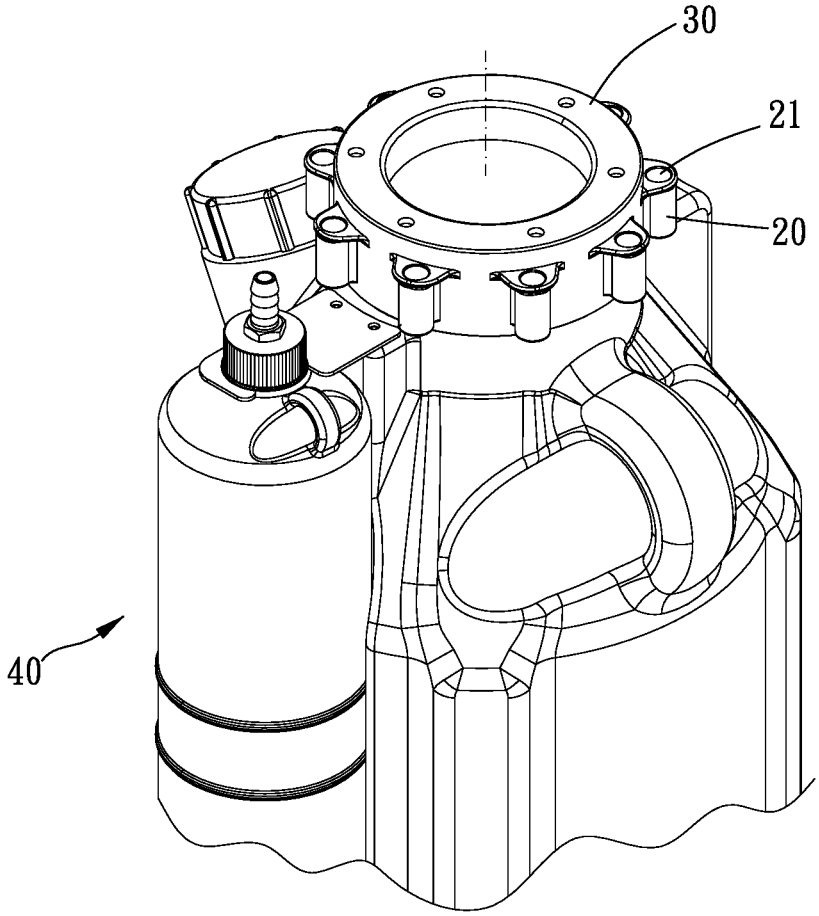
FIG. 6 is a stereogram showing a second embodiment of the present invention.

The ring body 10 is adapted for being sleeved onto the fluid pumping device 1, such as a liquid injector. The storage portions 20 is disposed on the ring body 10 around the ring body 20. Each of the storage portions 20 is adapted for a workpiece 2, such as a connector or handtool, removably connected for storage. The workpiece can be pipes installed on the fluid outlet or metal positioning elements. In addition, the storage portions can be also used to position the pipes. In the present embodiment, the ring body 10 is detachably disposed on a cover 4 the fluid pumping device 1. In other possible embodiments, as shown in FIG. 6, the ring body 10 can be a cover 30 disposed on a barrel 40 of the fluid pumping device. The cover 30 is detachably disposed on an opening 5 of the fluid pumping device 1. The ring body 10 can be used to cover a pumping mechanism 6 to allow the pumping device 6 to extend into the fluid pumping device 1.

More specifically, each of the storage portions 20 can be a clamping mechanism, an engaging mechanism, or other mechanisms for positioning each of the workpieces 2. In the present embodiment, each of the storage portions 20 has an insertion hole 21 for the workpiece 2 to removably insert through. More specifically, the insertion hole 21 can be a through hole for the workpiece 2 to insert through or a blind hole. Preferably, the insertion hole 21 is formed with a stepped face 22 radially. In the present embodiment, the stepped face 22 is an annular stepped face to support each of the workpieces 2. Besides, each of the storage portions 20 has a shoulder portion 23 around the insertion hole 21. The shoulder portion 23 extends radially. Preferably, the shoulder portions 23 is connected to the ring body 10 and expands toward the ring body 10 to enhance the engagement between each of the storage portions 20 and the ring body 10. In the present embodiment, each of the storage portions 20 is a seat protrudedly disposed on the ring body 10 around the ring body 10. The seat is formed with one of the insertion holes 21. Besides, the storage portions 20 are arranged spacedly in equal interval to reduce cost and to disperse the force. Preferably, the ring body 10 is further formed with a plurality of through holes 24. The through holes 24 and the insertion holes 21 are located at different positions along the radial direction of the ring body 10. Each of the through holes 24 can be used to receive the workpiece 2. Preferably, each of the insertion holes 21 has a different diameter from each of the through holes 24 to receive workpieces 2 in various sizes. In other possible embodiments, the insertion holes can have different diameters, and the through holes have different diameters too. In the present embodiment, the through holes 24 are arranged spacedly in equal interval to receive various workpieces 2 to prevent them from overlapping or collision.

More specifically, the ring body 10 is formed with a plurality of protrusions 25 on an inner wall thereof. The protrusions 25 can be engaged with recesses 7 of the fluid pumping device 1. In other possible embodiment, the protrusions can be formed on the fluid pumping device, and the recesses are formed on the inner wall of the ring body. In the present embodiment, the recesses 7 are formed on the cover 4 of the fluid pumping device 1. When the ring body 10 is sleeved onto the cover 4, the ring body 10 is unable to rotate due to the engagement between the protrusions 25 and the recesses 7. Besides, the ring body 10 has an expanded hole 26 in larger diameter and a reduced hole 27 in smaller diameter for being sleeved onto the fluid pumping device 1 for the installation of the cover and the pumping mechanism 6.

Figure 7:
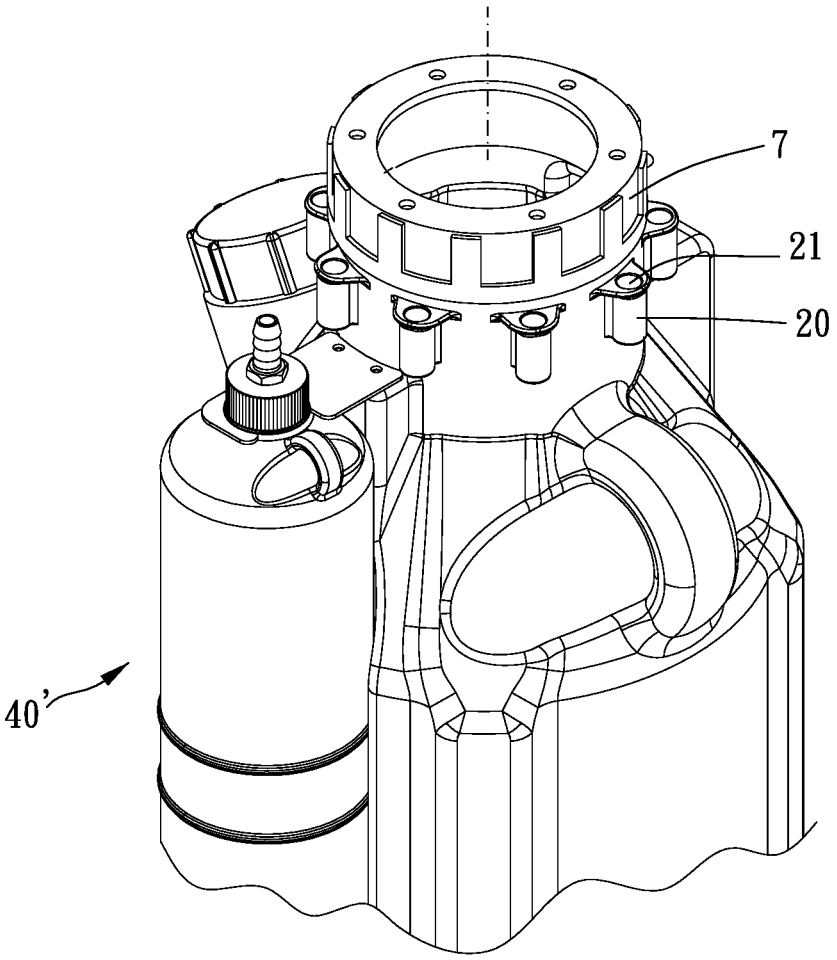
FIG. 7 is a stereogram showing a third embodiment of the present invention.

Besides, the storage structure for fluid pumping device further includes the barrel 40. The storage portions 20 are disposed on the outer face of the barrel 40 to surround the barrel 40. As shown in FIG. 7, the storage portions 20 are formed on the barrel 40' integrally or detachably. In the present embodiment, the barrel 40 further includes a main body 41 and a collection container 42 detachably disposed on the barrel 40. The storage portions 20 are disposed on the outer face of the main body 41 to surround the main body 41. Thus, the collection container 42 can be easily detached for cleaning. The collection container 42 is positioned on the outer face of the barrel 40. In other possible embodiments, the collection container can be clamped on the barrel or formed on the barrel integrally.

In conclusion, the storage portions can be formed on the barrel or the cover integrally or disposed on the ring body to be detachable from the barrel or the cover. Thereby, workpieces can be received well to promote the efficiency. Besides, the storage portions can be used to position the pipes.

What is claimed is:

1. A fluid pumping device having a storage structure, comprising:

a fluid pumping device, including a barrel and a pumping mechanism, the barrel having an opening, the pumping mechanism being adapted for communicating an interior of the barrel and exterior for pumping fluid;

a ring body, sleeved onto the fluid pumping device to surround the opening;

a plurality of storage portions, arranged around the ring body, each of the storage portions being adapted for a workpiece to removably connected;

wherein a plurality of protrusions are formed on an inner annular wall of the ring body, the protrusions are adapted for engaging with a plurality of recesses on the fluid pumping device; each of the storage portions has an insertion hole for the workpiece to be removably inserted through; a stepped face is radially formed in each of the insertion holes; each of the storage portions is a seat protrudedly formed on a periphery of the ring body, the seat is formed with one of the insertion holes; each of the storage portions has a shoulder portion around the insertion hole, the shoulder portion extends along a radial direction of the insertion hole; the shoulder portion is connected to the ring body and expands toward the ring body; the ring body is formed with a plurality of through holes, the through holes and the insertion holes are located at different positions along the radial direction of the ring body; an inner diameter of each of the insertion holes is different from an inner diameter of each of the through holes; the storage portions are arranged spacedly; the through holes are arranged spacedly; the ring body is formed with an expanded hole for being sleeved onto the barrel and a reduced hole.

2. The fluid pumping device having a storage structure of claim 1, wherein the ring body is a cover to cover the opening of the fluid pumping device.

3. The fluid pumping device having a storage structure of claim 1, wherein each of the storage portions has an insertion hole for the workpiece to be removably inserted through.

4. The fluid pumping device having a storage structure of claim 3, wherein a stepped face is radially formed in each of the insertion holes.

5. The fluid pumping device having a storage structure of claim 3, wherein each of the storage portions has a shoulder portion around the insertion hole, the shoulder portion extends along a radial direction of the insertion hole.

6. The fluid pumping device having a storage structure of claim 1, wherein each of the storage portions has an insertion hole, a plurality of through holes are formed on the ring body, the through holes and the insertion holes are located at different positions along a radial direction.

7. The fluid pumping device having a storage structure of claim 1, wherein the barrel further includes a main body and a collection container detachably disposed on the main body, the storage portions are arranged around the main body outside the main body.

* * * * *